US009493268B2

(12) United States Patent
Loftin et al.

(10) Patent No.: US 9,493,268 B2
(45) Date of Patent: Nov. 15, 2016

(54) PACKAGE WITH STRAP HANDLE

(71) Applicant: MeadWestvaco Packaging Systems, LLC, Richmond, VA (US)

(72) Inventors: Caleb Sutherland Loftin, Richmond, VA (US); Matthew Earl Zacherle, Chesterfield, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/438,245

(22) PCT Filed: Oct. 23, 2013

(86) PCT No.: PCT/US2013/066464

§ 371 (c)(1),
(2) Date: Apr. 24, 2015

(87) PCT Pub. No.: WO2014/066557

PCT Pub. Date: May 1, 2014

(65) Prior Publication Data

US 2015/0246745 A1 Sep. 3, 2015

Related U.S. Application Data

(60) Provisional application No. 61/717,802, filed on Oct. 24, 2012.

(51) Int. Cl.
*B65D 5/46* (2006.01)
*B65D 5/02* (2006.01)

(52) U.S. Cl.
CPC ..... *B65D 5/46* (2013.01); *B65D 5/0227* (2013.01); *B65D 5/46192* (2013.01)

(58) Field of Classification Search
CPC ..... B65D 5/0227; B65D 5/46192; B65D 2571/0046; B65D 2571/00462; B65D 5/46
USPC ..... 229/117.23, 117.13; 206/141, 200, 428
See application file for complete search history.

(56) References Cited

U.S. PATENT DOCUMENTS

| | | | | |
|---|---|---|---|---|
| 5,328,081 | A | 7/1994 | Saulas | |
| 5,639,017 | A * | 6/1997 | Fogle | B65D 5/46192 229/117.13 |
| 2003/0146269 | A1 | 8/2003 | Auclair | |
| 2005/0167476 | A1 * | 8/2005 | Ikeda | B65D 71/36 229/117.13 |

(Continued)

FOREIGN PATENT DOCUMENTS

| | | |
|---|---|---|
| EP | 2035285 | 3/2009 |
| EP | 2310290 B1 | 6/2012 |
| WO | 2005/123532 A1 | 12/2005 |

(Continued)

*Primary Examiner* — Christopher Demeree
(74) *Attorney, Agent, or Firm* — WestRock Intellectual Property Group

(57) ABSTRACT

A carton (8) has a top wall (120), end walls and a strap carrying handle (16). The carrying handle (16) includes a strap section (72, 74) that is formed at least partially in a top wall (120) of the carton (8). The strap section (72, 74) is deployable above the top wall (120) and is attached to each end of the carton (8). The carrying handle (16) further includes a handle structure (6) affixed to the underside of the strap section (72, 74). The handle structure (6) includes a series of foldably interconnected panels that is foldable into a substantially tubular structure having three or more sides disposed at least partially beneath the strap section (72, 74) of the carrying handle (16).

20 Claims, 11 Drawing Sheets

(56) References Cited

U.S. PATENT DOCUMENTS

| | | | |
|---|---|---|---|
| 2006/0261138 | A1 | 11/2006 | Bates |
| 2012/0018502 | A1 | 1/2012 | Walling et al. |

FOREIGN PATENT DOCUMENTS

| | | |
|---|---|---|
| WO | 2006/125173 | 11/2006 |
| WO | 2010-014862 | 2/2010 |

* cited by examiner

PACKAGE WITH STRAP HANDLE

CROSS REFERENCE TO RELATED APPLICATIONS

This application is a National Phase application of PCT Application PCT/US2013/066464 filed Oct. 23, 2013, which claims the benefit of U.S. Provisional Application No. 61/717,802, filed Oct. 24, 2012, each of which is incorporated herein by reference in its entirety.

FIELD OF THE INVENTION

The present invention relates to carrying handles for packages, more specifically, but not exclusively to strap (also referred to in this application as race-track) carrying handles comprising a 3-dimensional structured handle that is optionally automatically set-up as a user grasps the strap handle. Beneficially, such a strap carrying handle may provide a more comfortable and strong carrying handle.

BACKGROUND OF THE INVENTION

In the field of packaging it is often required to provide consumers with a package comprising multiple primary product containers, such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles. Yet a further consideration is how to make it easier for a consumer to grasp, lift and carry such multipacks. It is desirable to provide integral handles for this purpose. It is further desirable that such handles are strong, durable and comfortable to use, whilst still giving consideration to cost and environmental factors which require the handles to be formed from as little material as possible.

Strap handles (also referred to in this application as race-track handles) are known. Typically strap carrying handles are fixed to the ends of a carton and can be deployed into a raised condition so that a user can easily fit their hand about the strap for carrying the carton. One such strap carrying handle is known from EP 0,770,022 to the present applicant. In EP 0,770,022 a carton is disclosed having a strap handle that is automatically set-up into a raised, deployed position as the carton is being closed. The strap carrying handle comprises two plies of material that are affixed together in flat-face contacting relationship. As such the strap carrying handle of EP 0,770,022 is only as thick as the two plies of paperboard material.

Whereas the strap is suitable for many purposes, when the carton being carried is enclosing a significant weight (as is often the case with larger multipacks), the edges of the handle may dig or cut into the palm of a user's hand. Furthermore, a user must close their hand quite tightly about the thin strap handle. This can be uncomfortable for a user and in extreme cases may cause cramp in a user's hand.

The present invention seeks to provide an improvement in the field of strap carrying handles by providing a strap carrying handle with a 3-dimensional holding structure that is optionally automatically set-up as a user deploys the handle. The 3-dimensional holding structure provides a strong and deep structure that a user can comfortably grasp and hold for carrying a carton.

SUMMARY OF INVENTION

According to a first aspect of the present invention there is provided a carton comprising a strap carrying handle, the carton having a top wall and end walls and the strap carrying handle comprising a strap section that is formed at least partially in a top wall of the carton, that is deployable above the top wall and that is attached to each end of the carton, the strap carrying handle further comprising a handle structure affixed to an underside of the strap section, the handle structure comprising a series of foldably interconnected panels, which series of interconnected panels is foldable into an at least substantially tubular 3-dimensional structure having three or more sides disposed at least partially beneath the strap section of the strap carrying handle.

Optionally, the strap section comprises two plies of material affixed together in face contacting relationship and wherein the handle structure is affixed to the lowermost of the two plies.

Optionally, the series of foldably interconnected panels comprises: a hinge panel that is hinged to an edge of the strap section; a fixing panel that is affixed to an underside portion of the strap section; and one or more intermediate panels interconnected between the hinge panel and the fixing panel.

Optionally, the hinge panel is foldably connected to the strap section by a connection selected from the group consisting of: a linear weakened line, an arcuate weakened line, a linear fold line, an arcuate fold line, a linear series of full or half-depth cuts interrupted by crease lines and an arcuate series of full or half-depth cuts interrupted by crease lines.

Optionally, the one or more intermediate panels comprise a first intermediate panel and a weakened arrangement that facilitates the deformation of the first intermediate panel.

Optionally, the first intermediate panel is substantially rectangular and the weakened arrangement comprises any one or more or a combination of: an at least substantially centrally located aperture and four fold lines extending away from the aperture to each corner of the intermediate panel; two intersecting fold lines that each extend from a corner of the first intermediate panel diagonally across the first intermediate panel to the diagonally opposed corner; and a fold line extending longitudinally down the centre of the first intermediate panel.

Optionally, the first intermediate panel is at least partially deformed by being bowed outwardly, further below the strap section of the strap handle.

Optionally, the hinge panel is hinged to the strap section by means of an arcuate fold line bowing in a first direction and wherein the one or more intermediate panels is hinged to the fixing panel by means of another arcuate fold line bowing in a second direction that is opposite to and a mirror image of the arcuate fold line bowing in the first direction.

Optionally, the hinge panel is substantially segment-shaped; the second intermediate panel is hinged to the fixing panel and is substantially segment shaped; and the first intermediate panel is disposed between and interconnected to each of the hinge panel and the second intermediate panel.

Optionally, the handle structure has a non-uniform cross-section that is substantially a triangular shape or a three-sided shape at each end of the handle structure and that is a five sided shape in a medial section of the handle structure.

Optionally, the first intermediate panel is at least partially deformable about a longitudinal substantially centrally located fold line.

Optionally, the strap section comprises two plies of material affixed together in face contacting relationship, and wherein each ply of the strap section is at least in part defined by an arcuate hinge edge, wherein a cushioning flap is hinged to each arcuate hinge edge and wherein the arcuate hinge edges of the strap section are similarly shaped to the hinging edges of the segment shaped second intermediate panel and hinge panel.

Optionally, folding of the two cushioning flaps out of the plane of the strap section pushes against the hinge panel and the second intermediate panel of the handle structure and thereby automatically causes the handle structure to be set-up into a 3-dimensional structure.

According to another aspect of the invention, the strap carrying handle comprises a strap section formed from two-plies of material affixed together and having a handle structure affixed to an underside of the strap section, the handle structure comprising a series of foldably interconnected panels including a fixing panel, a hinge panel and one or more intermediate panels, which series of interconnected panels is foldable into an at least substantially tubular 3-dimensional structure having three or more sides disposed at least partially beneath the strap section, wherein each ply of the strap section is at least in part defined by a hinge edge and a cushioning flap is hinged to each hinge edge and wherein folding of the two cushioning flaps out of the plane of the strap section automatically causes the hinge panel and/or any of the one or more intermediate panels of the handle structure to be set-up into a 3-dimensional handle structure.

According to another aspect of the invention for which protection is sought, there is provided a blank for forming a carton having a strap carrying handle comprising a handle structure, the handle structure having three or more sides disposed at least partially beneath the strap section of the strap carrying handle and having an at least substantially tubular 3-dimensional structure, the blank comprising a top panel and end panels and a strap panel at least partially formed within the top panel and attached to the end panels, the handle structure comprising: a hinge panel hinged to the strap panel, one or more intermediate panels connected to the hinge panel and a fixing panel coupled to the one or more intermediate panels and affixable to an underside face of the strap panel for forming the handle structure.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Figure 1:
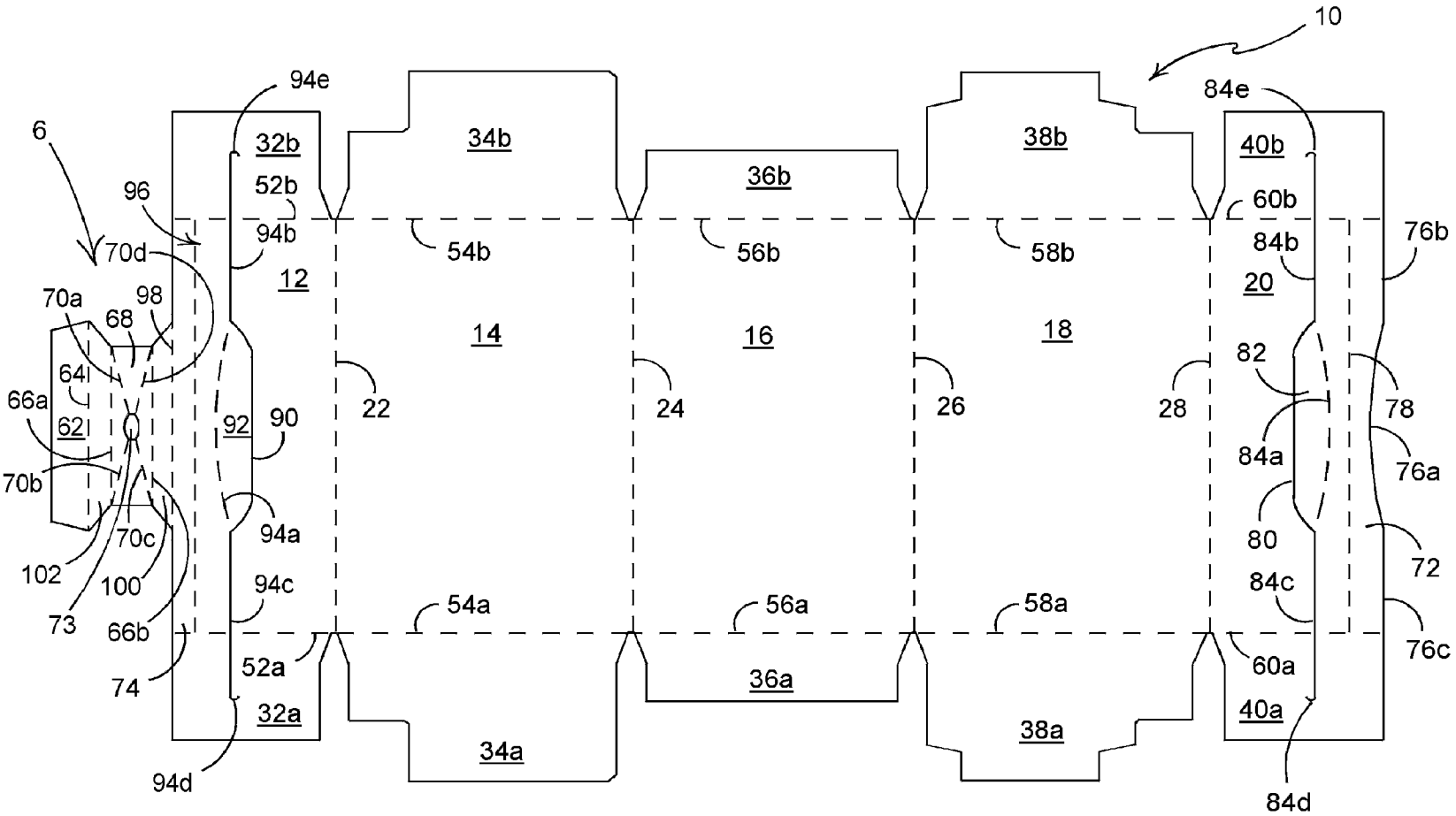
FIG. 1. is a plan view of a blank for forming a carton having a strap handle according to a first illustrated embodiment of the invention.

Detailed descriptions of specific embodiments of the strap carrying handles, packages, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the strap carrying handles, packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms carton and carrier refer, for the non-limiting purpose of illustrating the various features of the invention, to a container for engaging, carrying, and/or dispensing articles, such as cans. However, it is contemplated that the teachings of the invention can be applied to various containers, which may or may not be tapered and/or cylindrical. Other exemplary articles include bottles (for example metallic, glass or plastics bottles), cans (for example aluminium cans), tins, pouches, packets and the like.

The blanks 10, 110 shown herein are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carrier structure described in more detail below.

In the exemplary embodiment, the blanks 10, 110 are each configured to form a carton 8 or carrier for packaging an exemplary arrangement of exemplary articles. In the illustrated examples, the arrangement is a 2×3 matrix arrangement of 12 oz cans 'C'. The blanks 10, 110 can be alternatively configured to form a carrier for packaging other articles and/or different arrangements of articles.

The strap carrying handle of the present disclosure is described and illustrated herein in an exemplary and non-limiting application, namely in a fully enclosed, end loading style of carton. However it will be readily understood by the skilled reader and indeed it is envisaged that strap carrying handles of the present disclosure may be beneficially applied to a wide variety of carton types, including, for example, tray style cartons, wrap around cartons and open-ended cartons.

Figure 6:
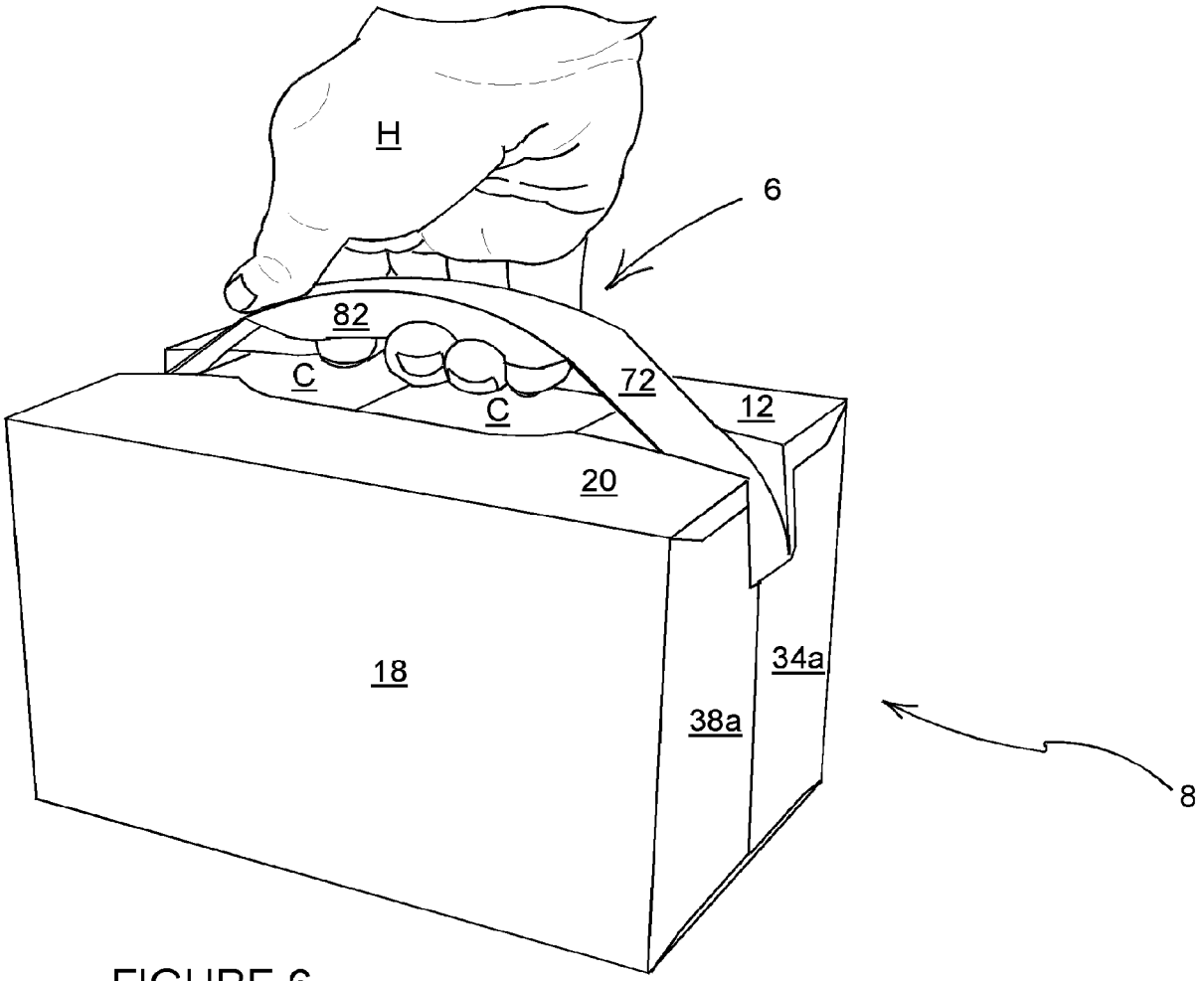
FIG. 6. is a perspective view from above of the carton formed from the blank of FIG. 1, loaded with cans and being carried by the strap carrying handle, wherein a user is grasping the handle structure.

Referring to the blank 10 of FIG. 1, the blank 10 is for forming a fully enclosed type carton and therefore comprises a series of main panels including: an inner top panel 12, a first side panel 14, a bottom panel 16, a second side panel 18 and an outer top panel 20. The main panels are optionally hinged one to the next in series by longitudinal fold lines 22, 24, 26 and 28. End closure panels are provided for forming composite end walls of the carton 8 (see FIG. 6). Inner top end closure panels 32*a*, 32*b* are hinged to each end of the inner top panel 12 by transverse fold lines 52*a*, 52*b*. First side end closure panels 34*a*, 34*b* are hinged to each end of the first side panel 14 by transverse fold lines 54*a*, 54*b*. Bottom end closure panels 36*a*, 36*b* are hinged to each end of the bottom panel 16 by transverse fold lines 56*a*, 56*b*. Second side end closure panels 38*a*, 38*b* are hinged to each end of the second side panel 18 by transverse fold lines 58*a*, 58*b*. Outer top end closure panels 40*a*, 40*b* are hinged to each end of the outer top panel 20 by transverse fold lines 60*a*, 60*b*.

Each of the inner and outer top panels 12, 20 comprises a strap section 72, 74. The strap section 72 of the outer top panel 20 is defined by an outer cut edge 76*a*, 76*b*, 76*c* and an inner cut edge 84*c*, 80, 84*b*. The inner cut edge 84*c*, 80, 84*b* comprises a cushioning flap 82 that is hinged to the strap section 72 along an optionally arcuate hinge connection 84*a*. Preferably, the opposite edge 76*a* is similarly arcuately shaped such that the strap section 72 resembles an hour glass in shape having a tapered medial strap section. The strap section 72 is affixed to the blank 10 by being contiguous with each of the outer top end closure panels 40*a*, 40*b*. The inner cut edge 84*c*, 80, 84*b* extends into the outer top end closure panels 40*a*, 40*b* and terminates in arcuate stops 84*e*, 84*d* which prevent or at least mitigate against the strap section 72 being separated from the outer top end closure panels 40*a*, 40*b*.

Similarly, the strap section 74 of the inner top panel 12 is defined by an outer cut edge that is substantially straight and an inner cut edge 94*c*, 90, 94*b*. The inner cut edge 94*c*, 90, 94*b* comprises a cushioning flap 92 that is hinged to the strap section 74 along an optionally arcuate hinge connection 94*a*. The opposite edge is a hinged edge 98 which connects a handle structure to the medial section of the strap 74. The strap section 74 is affixed to the blank 10 by being contiguous with each of the inner top end closure panels 32*a*, 32*b*. The inner cut edge 94*c*, 90, 94*b* extends into the inner top end closure panels 32*a*, 32*b* and terminates in arcuate stops 94*e*, 94*d* which prevent or at least mitigate against the strap section 74 being separated from the inner top end closure panels 32*a*, 32*b*. An optional medial fold line 94 may assist in the formation of a comfortable strap handle (see FIG. 6). Similarly, an optional medial fold line 78 may be disposed on strap section 72.

A handle structure 6 is formed from a series of interconnected panels hinged to the inner strap section 74 because this inner strap section 74 is the lowermost ply of the strap-handle 72/74. The handle structure 6 comprises a hinge panel 100 that is directly hinged to a medial section of the strap section 74 opposite to the cushioning flap 92 and arcuate fold line 94*a*. The handle structure 6 also comprises a fixing panel 62 that is configured to attach the series of interconnected panels of the handle structure 6 to the underside face of the medial portion of the strap section 74. One or more intermediate panels 68, 102 are provided between the hinge panel 100 and the fixing panel 62. A first intermediate panel 68 is hinged along fold line 66*b* to the hinge panel 100 and a second intermediate panel 102 is hinged to the first intermediate panel 68 by fold line 66*a* and to the fixing panel 62 by fold line 64. Optionally, the first intermediate panel 68 is substantially rectangular and comprises a weakened arrangement optionally for facilitating the deformation of the intermediate panel 68 once the handle structure 6 is set-up. The weakened arrangement may comprise an at least substantially disposed aperture 73. Optionally, four fold lines 70*a*, 70*b*, 70*c*, 70*d* extend between each corner of the first intermediate panel 68 and the aperture 73. The fold lines 70*a*, 70*b*, 70*c*, 70*d* and aperture 73 are entirely optional. When provided, the fold lines 70*a*, 70*b*, 70*c*, 70*d* and aperture 73 may assist the deformation or partial collapse of the first intermediate panel 68 as will be described further below. To further assist with the folding of the first intermediate panel 68, the fold lines 66*b* and 66*a* may be formed as an alternating series of half-depth or full-depth cut lines and crease lines.

Optionally, the hinge panel 100 and second intermediate panel 102 are similarly shaped. Optionally, the hinge panel 100 and second intermediate panel 102 are each longer than the first intermediate panel 68 and are substantially trapezoidal in shape. Preferably, the fixing panel 62 is sized such that its width at any point along its length is not greater than the width of a corresponding part of the strap section 74 (along its medial section adjacent to the arcuate hinge line 94*a*).

Figure 2:
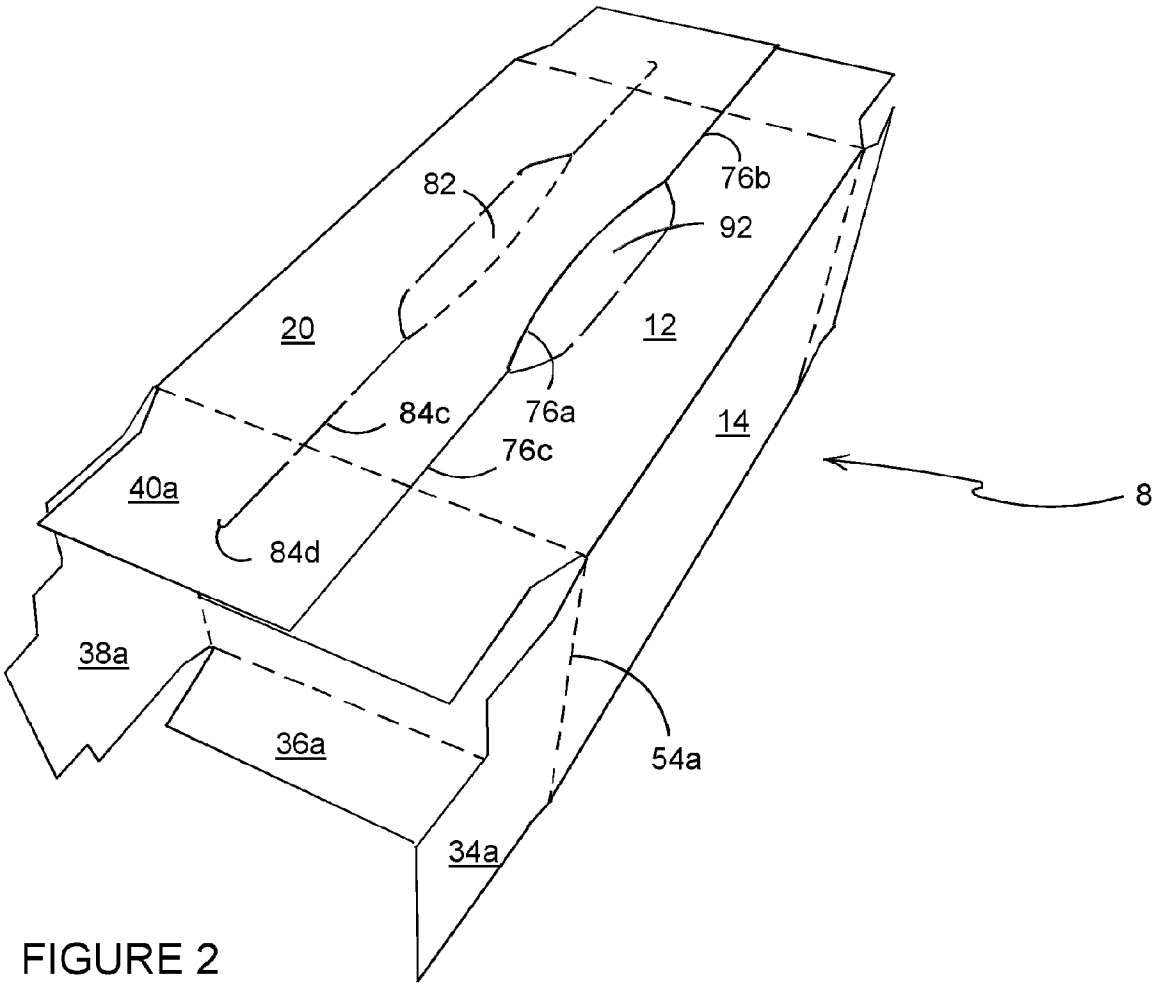
FIG. 2. is a perspective view from above of the top, a side and an open end of a part-formed carton being constructed from the blank of FIG. 1.
Figure 3:
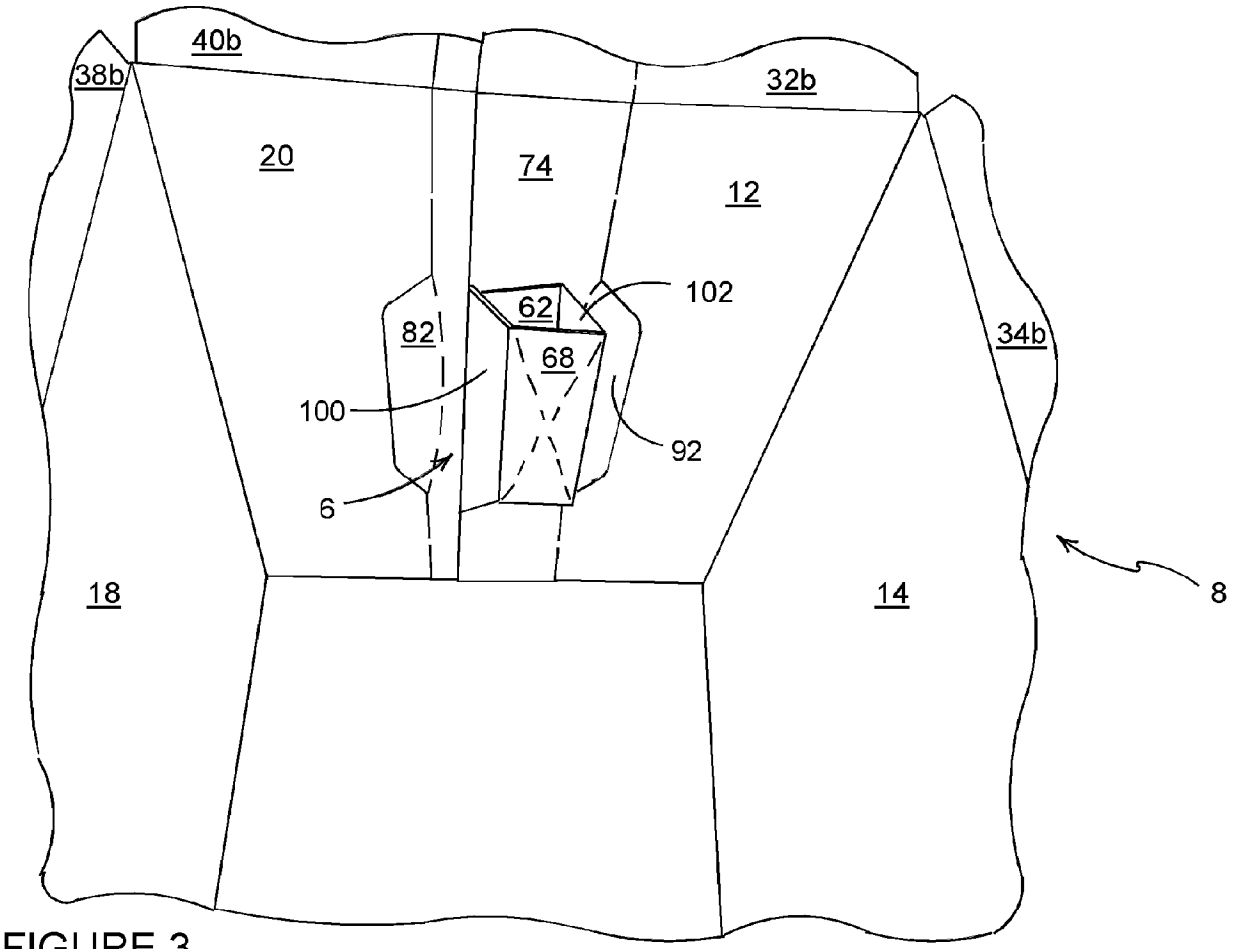
FIG. 3. is a perspective internal view from below of the carton of FIG. 2 showing a handle structure affixed to an underside of a strap section of the strap carrying handle according to the first embodiment of the invention.
Figure 4:
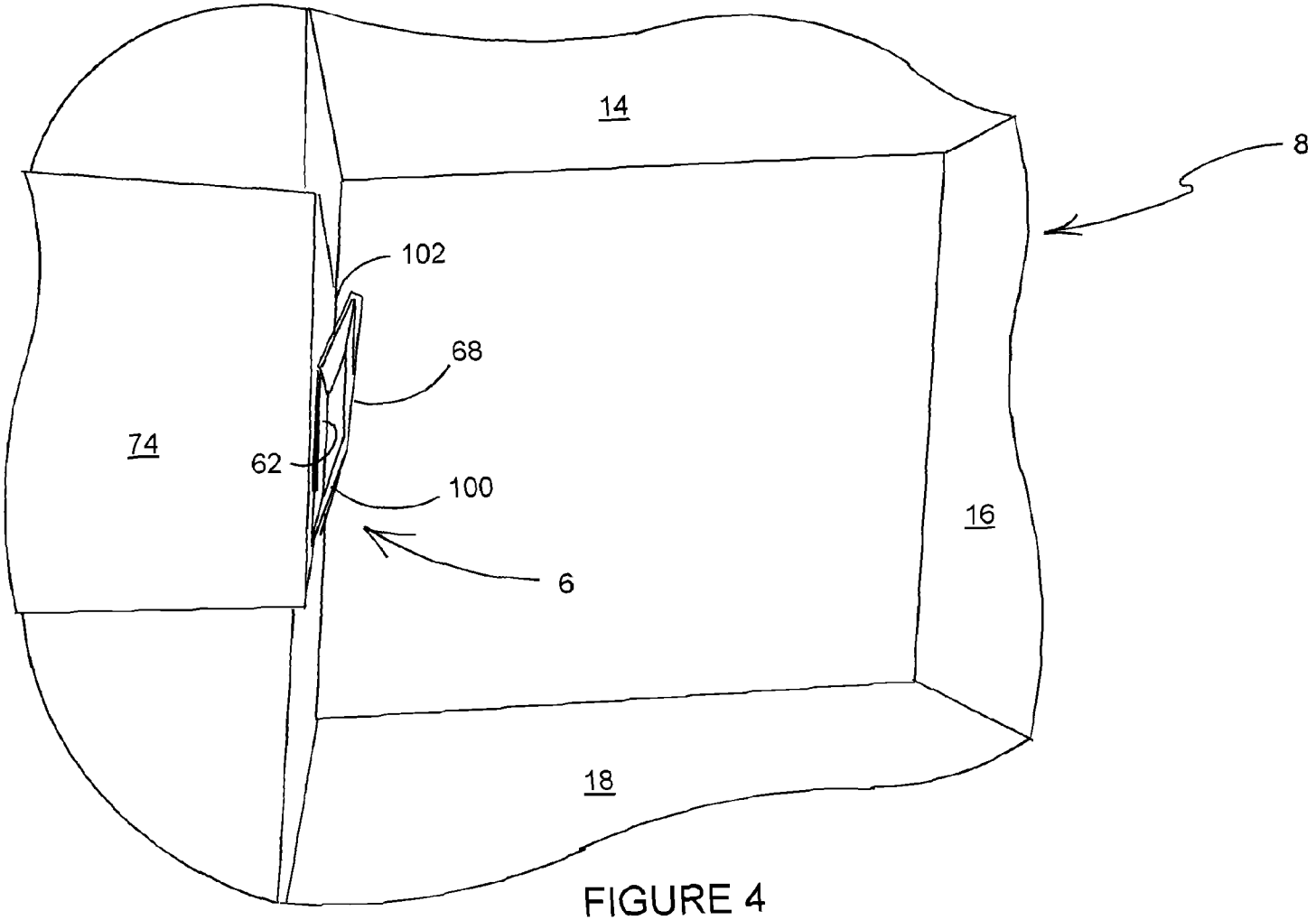
FIG. 4. is an internal view from an end of the side of the handle structure affixed to the underside of the strap section of the strap carrying handle.

Turning to the construction of the carton 8 and handle structure 6 as illustrated in FIGS. 2, 3 and 4 it is envisaged that the carton 8 can be formed by a series of sequential folding operations in a straight line machine so that the carton 8 is not required to be rotated or inverted to complete its construction. The folding process is not limited to that described below and may be altered according to particular manufacturing requirements.

The fixing panel 62 is affixed to the inside face of the medial portion of the strap-section 74, proximate to the cushioning flap 92. Optionally, this may be achieved by folding the fixing panel 62 about fold line 64 such that the fixing panel 62 is disposed with its inside surface in face contacting relationship with the inside face of the second intermediate panel 102 and part of the inside face of the first intermediate panel 68. Adhesive may be applied to one or both of the outside face of the fixing panel 62 and the inside face of the medial portion of the strap section 74. Then, the handle structure 6 is folded again, this time about fold line 66*b*, such that the outside face of the fixing panel 62 is brought into face contacting relationship with the inside face of the medial portion of the strap section 74 and affixed thereto. In other embodiments other affixing means may be used additionally or alternatively to adhesive, for example, sticking tape, and mechanical fasteners may be used.

With the hand structure 6 disposed in a flat-folded condition beneath the strap-section 74, the blank 10 is then further folded about fold line 24. In this way, the inside faces of the inner top panel 12 and first side panel 14 are brought into overlapping relationship with the inside faces of the bottom panel 16 and second side panel 18. Adhesive may be applied to the outer face of the strap section 74. The outer top panel 20 is then folded about fold line 28 to bring the inside face of the strap section 72 into face-contacting relationship with the outer surface of the strap section 74 such that the two strap-sections are affixed together along their length. When the outer top panel 20 is folded about fold line 28, the cushioning flap 82 may be disposed in face contacting relationship with the hinge panel 100 of the handle structure 6. Optionally, the cushioning flap 82 is not affixed to the hinge panel 100, in some embodiments the cushioning flap 82 is may be affixed to the hinge panel 100. The affixed and folded handle structure 6 is illustrated in FIGS. 3 and 4. Advantageously the handle structure 6 can be stowed in a substantially flat-folded condition and therefore no additional capacity (or at least very little additional capacity) within the interior of the carton 8 is required to accommodate the flat-folded handle structure 6. The handle structure 6 is only moved into its tubular, 3-dimensional form once the handle is deployed above the plane of the top panel 20 and at that time, the additional space required for the handle structure 6 is automatically provided.

The part-formed flat folded blank may then be transported to a converting plant, whereat it is opened up into an open ended tubular structure (see FIG. 2) and loaded with articles such as cans 'C' through one or both of its ends. The composite end walls are formed in a normal manner, folding each end closure panel 32*b*, 34*b*, 36*b*, 38*b*, 40*b*; 32*a*, 34*a*, 36*a*, 38*a*, 40*a* about its fold line 52*b*, 54*b*, 56*b*, 58*b*, 60*b*; 52*a*, 54*a*, 56*a*, 58*a*, 60*a* and affixing the end closure panels 32*b*, 34*b*, 36*b*, 38*b*, 40*b*; 32*a*, 34*a*, 36*a*, 38*a*, 40*a* of each composite end wall together.

Figure 5:
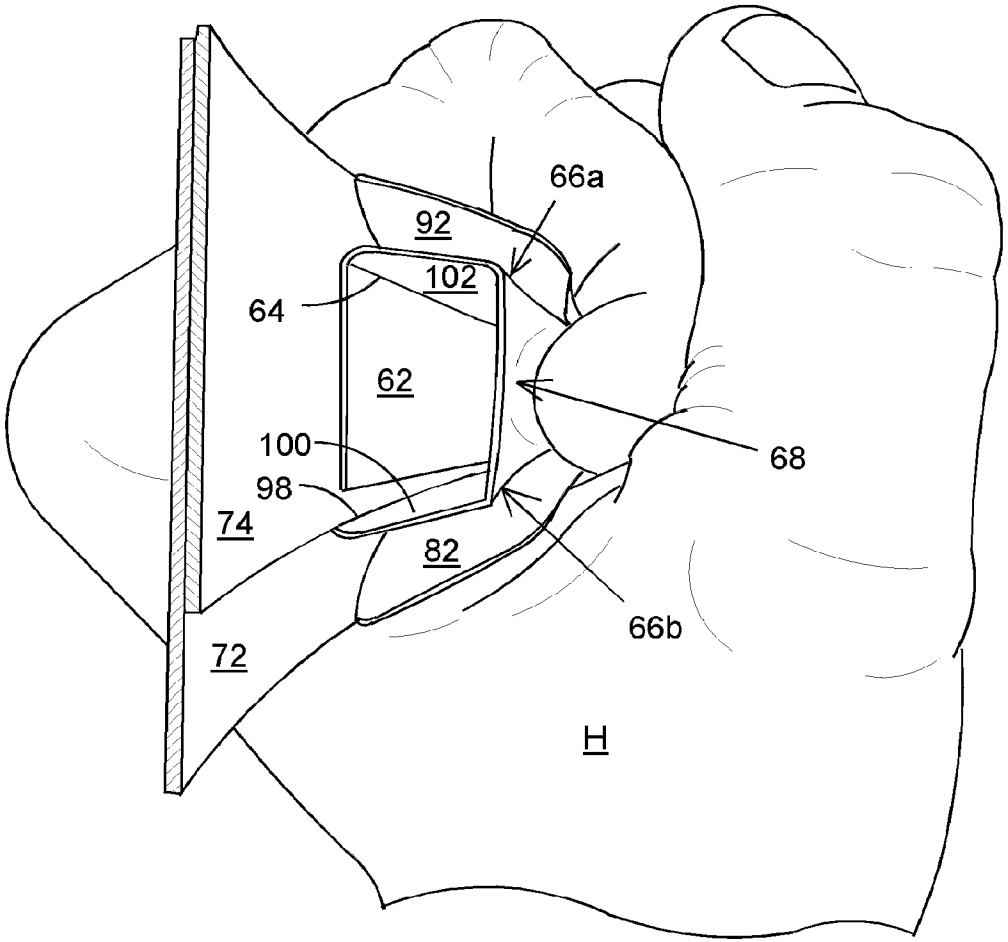
FIG. 5. is a perspective view from the end of the strap carrying handle of the carton of FIGS. 2-4, wherein one end of the strap carrying handle has been cut away from the carton for ease of viewing the structure of the strap carrying handle.

To deploy the strap carrying handle, a user folds the cushioning flaps 82, 92 inwardly of the inner and outer top panels 12, 20, optionally this may involve breaking one or more connecting nick portions that may be providing a frangible link between the cushioning flaps 82, 92 and/or the strap section 72/74 and the adjacent top panel 12, 20. Folding of the cushioning flaps 82, 92 inwardly pushes the hinge panel 100 and second intermediate panel 102 of the handle structure 6 toward one another, thus causing the handle structure to open up into a tubular 3-dimensional structure having four sides. Optionally, the set-up handle structure has a uniform cross-sectional shape along its length that is at least substantially rectangular. In FIG. 5, the strap handle has been cut-away from the carton 8 in order to illustrate the handle structure 6 beneath the strap handle 72/74. The four-sided substantially rectangular cross-sectional shape of the handle structure 6 can be seen. The co-operation of the cushioning flaps 82, 92 can also be seen and it is clear that the handle structure 6 provides a deeper, more structured handle for a user to grasp in their hand H compared to only holding two plies of flat material. Further it is illustrated that the weakened arrangement comprising the optional fold lines 70*a*, 70*b*, 70*c*, 70*d* and optional aperture 73 facilitates the deformation of the first intermediate panel 68. Optionally, the first intermediate panel deforms by collapsing slightly toward the strap handle 72/74. In other embodiments one or more of the intermediate panels may deform by bowing outwardly away from the strap 72/74 (see second illustrated embodiment of FIG. 7 for example). The collapse or deformation of one or more of the intermediate panels is preferably configured to facilitate or encourage the upward and substantially arcuate bowing of the strap handle 72/74 (see FIG. 6 for example)

Referring now to FIGS. 7-11, there are shown alternative embodiments of the present invention. In the second, third and fourth illustrated embodiments, like numerals have, where possible, been used to denote like parts, albeit with the addition of the prefix "100", "200" and "300" to indicate that these features belong to the second, third and fourth embodiments respectively. The alternative embodiment shares many common features with the first embodiment and therefore only the differences from the embodiment illustrated in FIGS. 1 to 6 will be described in any greater detail.

Figure 7:
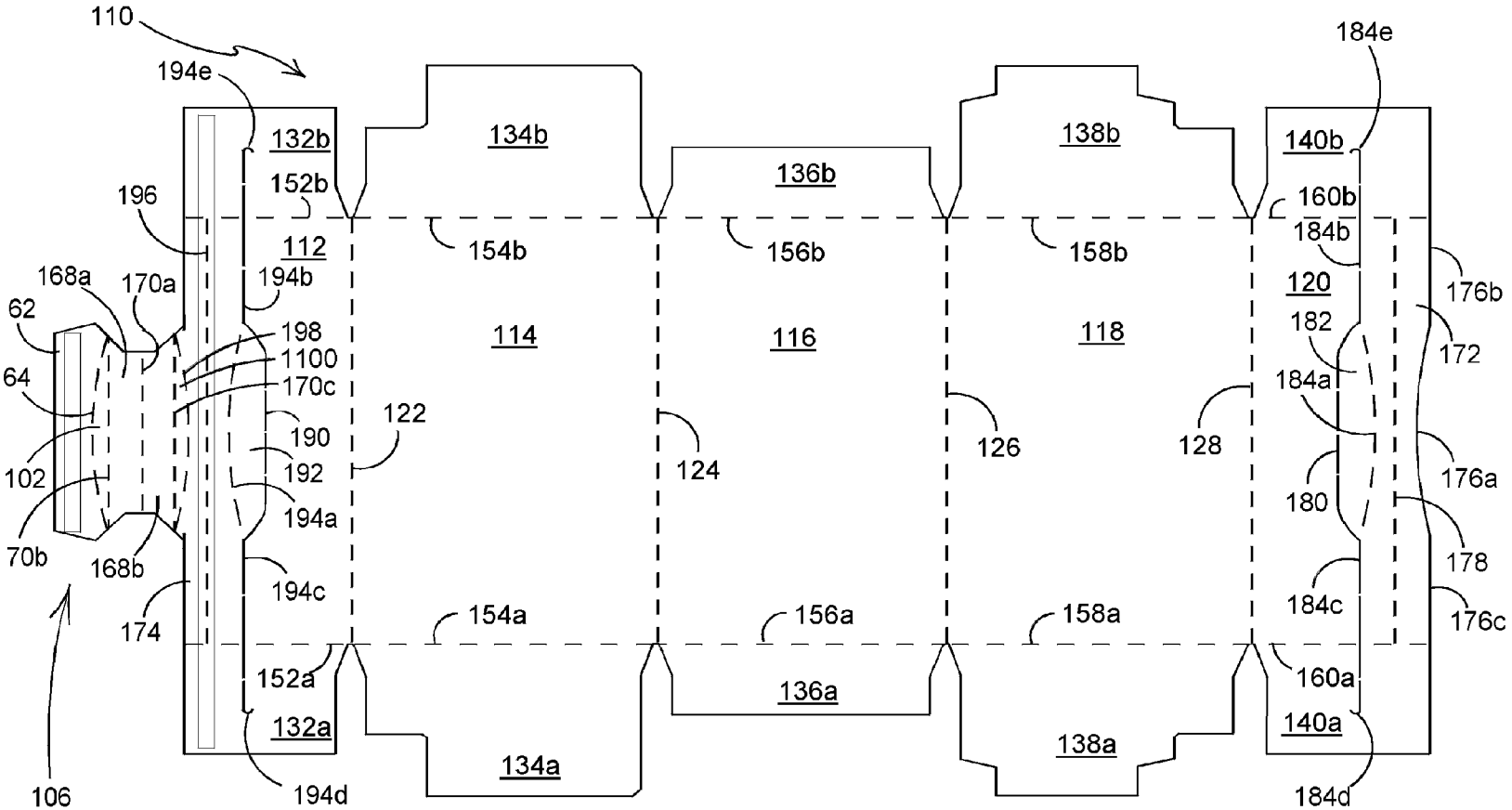
FIG. 7. is a plan view of a blank for forming a carton having a strap handle according to a second illustrated embodiment of the invention.
Figure 8:
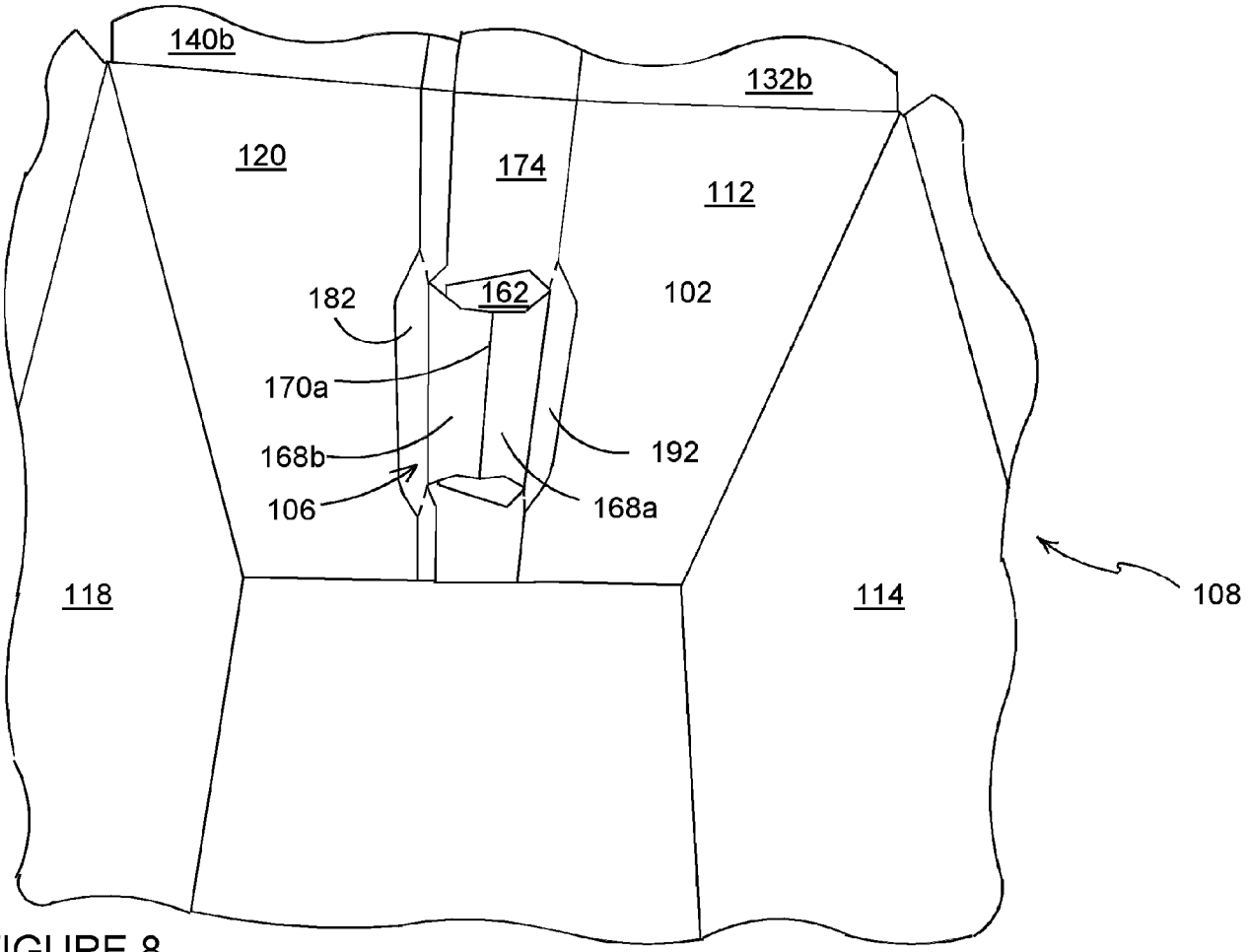
FIG. 8. is a perspective internal view from below of a carton formed from the blank of FIG. 7 showing a handle structure affixed to an underside of a strap section of the strap carrying handle according to a second illustrated embodiment of the invention.

In FIG. 7, the handle structure 106 comprises: a segment shaped hinge panel 1100 hinged to the strap section 174 along an arcuate fold line 198. A first intermediate panel 168*b* is hinged to the hinge panel 1100 along a linear fold line 170*c*. A second intermediate panel 168*a* is hinged to the first intermediate panel 168*b* along a weakened arrangement formed as a fold line 170*a*. The second intermediate panel 168*a* is hinged to a substantially segment shaped third intermediate panel 1102. The third intermediate panel 1102 is hinged by an arcuate fold line 164 to a fixing panel 162. Optionally, the fixing panel 162 has a width that is approximately the same width and similar shape as the medial section of the strap section 174. Preferably in this arrangement, the arcuate fold lines 164 and 198 are at least approximately shaped and sized similarly to and to match the shape and size of the hinge connections 194*a*, 184*a* connecting the cushioning flaps 192, 182 to the medial sections of the strap sections 174, 172. As such, when the handle structure 106 is assembled (by affixing the fixing panel 162 to the underside of the lowermost strap section 196 as described above and illustrated in FIGS. 8 and 9), the arcuate fold lines 164 and 198 and hinge connections 194*a*, 184*a* are disposed adjacent to one another. (In other envisaged embodiments the arcuate fold lines 164 and 198 and hinge connections 194*a*, 184*a* are disposed in a full or partial overlapping condition). This may encourage and assist in moving the handle structure 106 from a substantially flat-folded form into an erected form.

In the substantially flat-folded form the segment shaped hinge panel 1100 and the segment shaped third intermediate panel 1102 are partially overlaid by the cushioning flaps 182, 192 and the first intermediate panel 168*b* and second intermediate panel 168*a* are disposed beneath the fixing panel 162 and strap sections 174, 172 respectively. The first intermediate panel 168*b* and second intermediate panel 168*a* are disposed in a slightly spaced condition relative to the fixing panel 162 and are not necessarily disposed in flat-face contacting relationship therewith. As such in the "flat-folded form" the handle structure 106 is already slightly 3-dimensional. As the handle structure 106 is fully set-up the cushioning flaps 192, 182 are folded about fold lines 184*a*, 194*a* and towards the handle structure 106. This causes the cushioning flaps 192, 182 to press against each of the segment shaped hinge panel 1102, the third intermediate panel 1100 and the folded edges 170*b*, 170*c*. In doing so, the first intermediate panel 168*b* and second intermediate panel 168*a* are caused to fold about the longitudinal fold line 170*a* and the handle structure 106 adopts a more rigid three-dimensional structure. The three-dimensional structure is held in its erected form by the user gripping the handle cushioning flaps 182, 192. To fold the handle structure 106 back into its "flat-folded form" the inward force being applied by the user to the cushioning flaps 182, 192 would need to be overcome and as such once gripped by the user, the handle structure is a rigid construction that provides a comfortable "bar" or "shaft" for the user to hold.

As described above, the handle arrangement 106 of the present embodiment may be a firm structure to grasp and may be readily set-up due to: the proximity (i.e. overlap) of the cushioning flaps and the folded edges 170*b*, 170*c*; and/or due to the overlapping of the segment shaped panels 1102, 1100 and the cushioning flaps 182, 192; and/or due to the segment shaped panels 1102, 1100 providing angled sides of the handle structure 106 which the cushioning flaps 192, 182 can fit or nest against. Optionally the weakened arrangement 170*a* assists in the set-up of the handle structure 106 by enabling the first and second intermediate panels 168*b*, 168*a* to fold, deform and bulge outward below the strap sections 174/172 (best viewed in FIG. 9).

Figure 9:
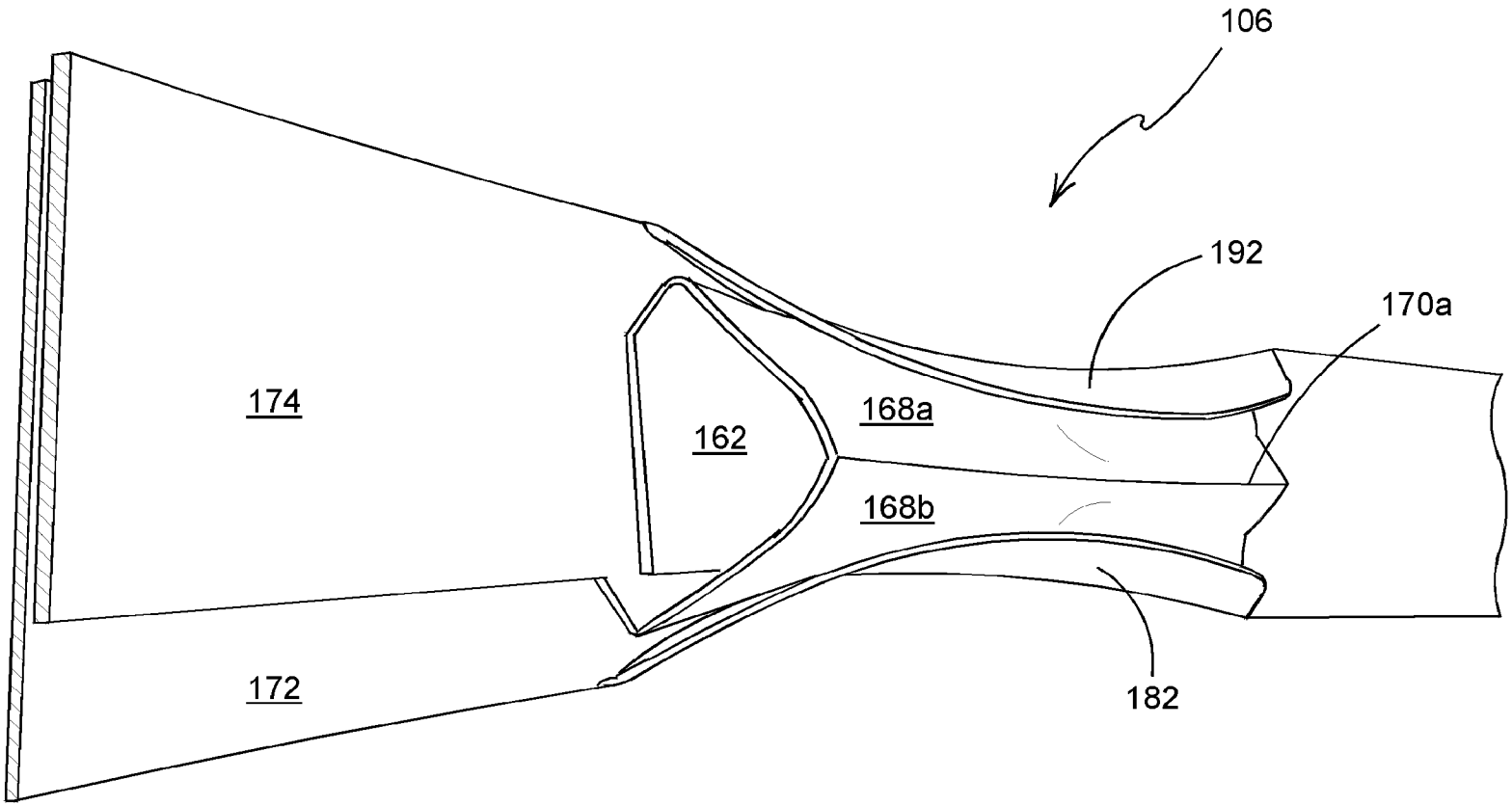
FIG. 9. is a perspective view from the end of the strap carrying handle of FIG. 8, wherein one end of the strap carrying handle has been cut away from the carton for ease of viewing the structure of the strap carrying handle.

The set-up handle structure 106 in tubular 3-dimensional form has a non-uniform cross-sectional shape along its length (best illustrated in FIG. 9). Where the segment shaped hinge panel 1102 and the third intermediate panel 1100 are narrowest in width (at their opposite ends), the set-up handle structure 106 is at least substantially triangular or three-sided in cross-sectional shape. However in a central region of the handle structure 106, where the segment shaped hinge panel 1102 and the third intermediate panel 1100 are wider, the set-up handle structure 106 is at least substantially pentagonal or five-sided in cross-sectional shape. The set-up tubular handle structure 106 co-operates with the handle strap 172, 174 to allow the gripping region held by a user to bow above the carton top wall 112/120.

Figure 10:
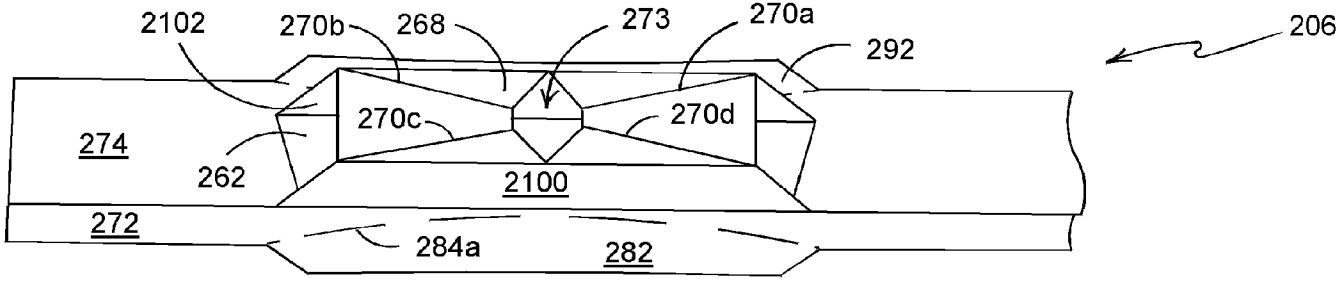
FIG. 10. is a perspective internal view from below of a carton showing a handle structure affixed to an underside of a strap section of a strap carrying handle according to a third illustrated embodiment of the invention.
Figure 11:
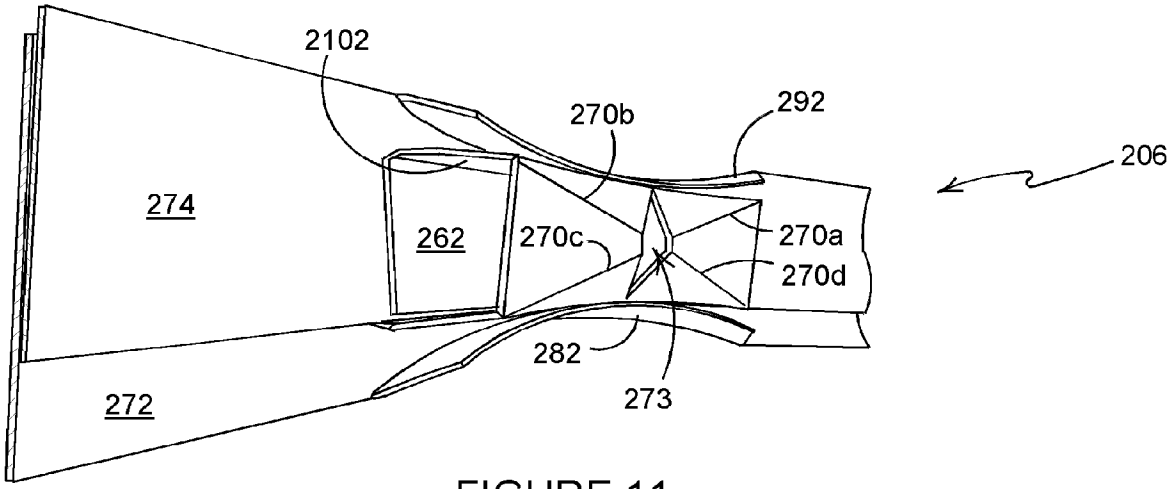
FIG. 11. is a perspective view from the end of the strap carrying handle of FIG. 10, wherein one end of the strap carrying handle has been cut away from the carton for ease of viewing the structure of the strap carrying handle.

In FIGS. 10 and 11, a handle structure 206 according to a third embodiment is shown in an erect form. The handle structure 206 comprises: a rectangular shaped hinge panel 2100 hinged to the strap section 274 along a substantially straight fold line. A first intermediate panel 268*b* is hinged to the hinge panel 2100 and is hinged to a substantially rectangular shaped second intermediate panel 2102. The second intermediate panel 2102 is hinged by a linear fold line to a fixing panel 262. Optionally, the fixing panel 262 has a width that is smaller than the width of the medial section and similar in shape to the medial section of the strap section 274. Preferably in this arrangement, the first intermediate panel 268 comprises an aperture 273 which extends optionally entirely across the first intermediate panel 268 and terminates on the fold lines between the first intermediate panel 268 and the hinge panel 2100 and second intermediate panel 2102. The aperture 273 optionally is hexagonal in shape and a weakened arrangement of fold lines 270*a*, 270*b*, 270*c*, 270*d* is optionally provided extending from opposed and centrally disposed edges of the hexagonal aperture 273 and to the corners of the first intermediate panel 268.

Optionally the weakened arrangement 270*a*, 270*b*, 270*c*, 270*d* assists in the set-up of the handle structure 206 by enabling the first intermediate panel 268 to deform and bulge at least in part outwardly (downwardly) below the strap sections 274/272 (best viewed in FIG. 11).

The set-up handle structure 206 in tubular 3-dimensional form may have a non-uniform cross-sectional shape along its length (again, best illustrated in FIG. 11) due to the relative folded positions of the six portions of the first intermediate panel 268 defined by the four fold lines 270*a*, 270*b*, 270*c*, 270*d*. When the handle structure 206 transitions from the "flat-folded form" to the erect position, in which the handle structure 206 is gripped, the four acute portions of the first intermediate panel 268 (that are disposed alongside the fold lines between the first intermediate panel 268 and the rectangular shaped hinge panel 2100 and the rectangular shaped second intermediate panel 2102 respectively), may optionally fold out of a plane parallel with the top wall 212, 220 and at an angle thereto such that each of the four portions slants towards a cushioning flap 182, 192 (based on the view provided in FIG. 11). At the same time, the remaining larger portions may slant such that their highest part is closest to the aperture 273 and such that their lowest part is disposed furthest from the aperture 273 (highest and lowest relative positioning terms being based upon viewing the handle in its normal in-use position and not in the upside down positions shown in FIGS. 10 and 11). In this way, the strap handle is permitted or encouraged to bow upwardly (relative to the plane of the top wall 212/220) and arcuately. In such a form, the strap handle is more easily grasped for comfortably and securely carrying the carton.

Figure 12:
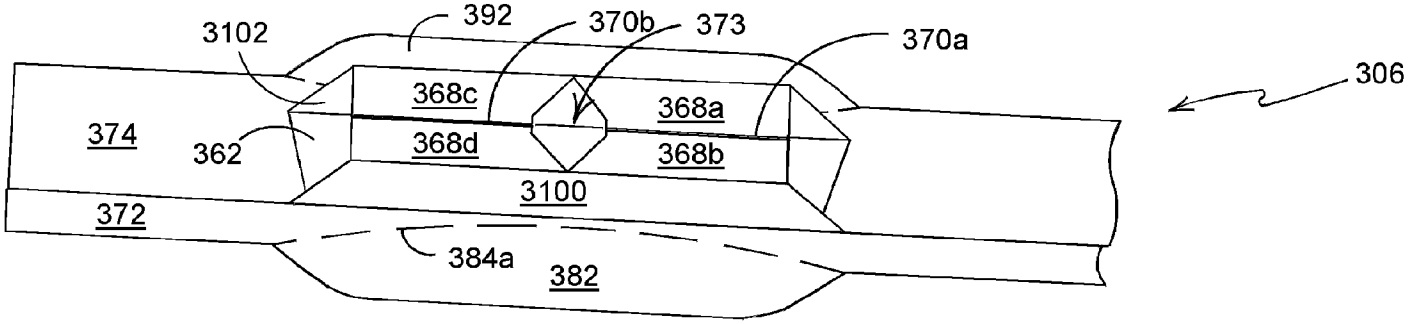
FIG. 12. is a perspective internal view from below of a carton showing a handle structure affixed to an underside of a strap section of a strap carrying handle according to a fourth illustrated embodiment of the invention.
Figure 13:
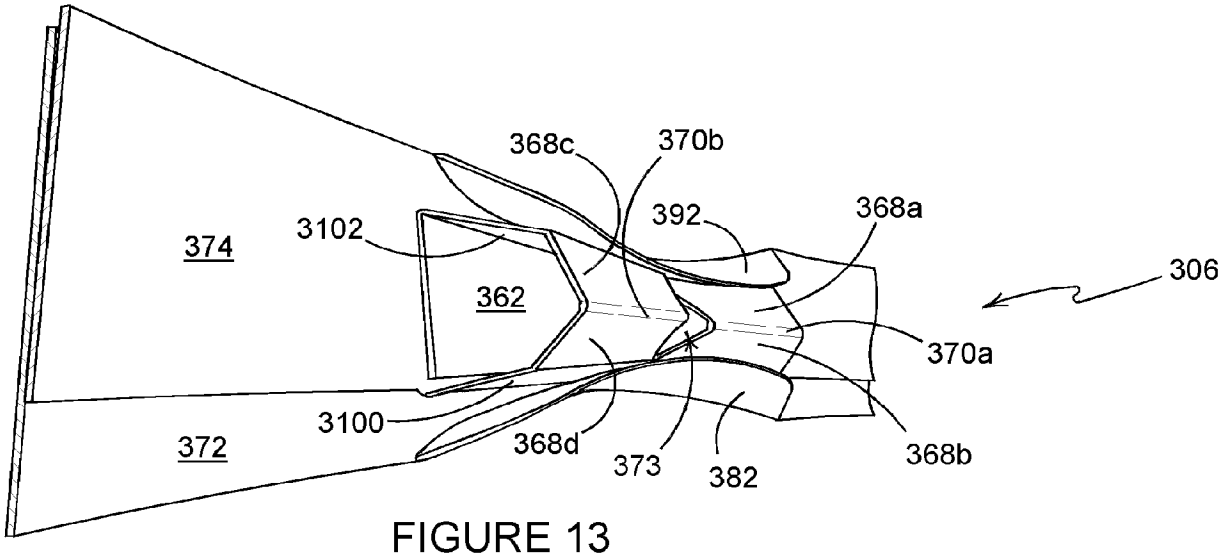
FIG. 13. is a perspective view from the end of the strap carrying handle of FIG. 12, wherein one end of the strap carrying handle has been cut away from the carton for ease of viewing the structure of the strap carrying handle.

In FIGS. 12 and 13, a handle structure 306 according to a fourth embodiment is shown in an erect form. The handle structure 306 comprises: a rectangular shaped hinge panel 3100 hinged to the strap section 374 along a substantially straight fold line. A first intermediate panel comprising four sections 368*a*, 368*b*, 368*c*, 368*d* is hinged to the hinge panel 3100 and is hinged to a substantially rectangular shaped second intermediate panel 3102. The second intermediate panel 3102 is hinged by a linear fold line to a fixing panel 362. Optionally, the fixing panel 362 has a width that is smaller than the width of the medial section and similar in shape to the medial section of the strap section 374. Preferably in this arrangement, the first intermediate panel 368*a*, 368*b*, 368*c*, 368*d* comprises an aperture 373 which extends, optionally, entirely across the first intermediate panel 368*a*, 368*b*, 368*c*, 368*d* and terminates on the fold lines between the first intermediate panel 368*a*, 368*b*, 368*c*, 368*d* and the hinge panel 3100 and second intermediate panel 3102. The aperture 373 optionally is hexagonal in shape, having six edges, and a weakened arrangement of fold lines 370*a*, 370*b*, is provided. A fold line 370*a*, 370*b* extends from each of the opposed and centrally disposed edges of the hexagonal aperture 373 toward the free end edge of the first intermediate panel 368*a*, 368*b*, 368*c*, 368*d*.

Optionally the weakened arrangement 370*a*, 370*b* assists in the set-up of the handle structure 306 by enabling the first intermediate panel 368*a*, 368*b*, 368*c*, 368*d* to deform and bulge substantially outwardly below the strap sections 374/372 (best viewed in FIG. 13). The set-up handle structure 306 in tubular 3-dimensional form may have a substantially uniform cross-sectional pentagonal (five-sided) shape along its length (again, best illustrated in FIG. 13) due to medially positioned and longitudinally extending fold lines 370*a*, 370*b*. The relative folded positions of the four portions 368*a*, 368*b*, 368*c*, 368*d* of the first intermediate panel are defined by the two fold lines 370*a*, 370*b*. The aperture 373 and fold lines 370*a*, 370*b* assist in the handle structure 306 adopting a 3-dimensional structure that encourages and allows the strap 372, 374 to bend or bow arcuately above the plane of the top wall of the carton.

It can be appreciated that various changes may be made within the scope of the present invention, for example, the size and shape of the panels and apertures may be adjusted to accommodate articles of differing size or shape. In other embodiments of the invention it is envisaged that the weakened arrangement may comprise a wide variety of features. It will be recognised that a variety of features may be used in a weakened arrangement to encourage and control the deformation of one or more of the intermediate panels of the handle structure. For example, in other embodiments, no aperture may be provided and the weakened arrangement may comprise two intersecting fold lines that each extend from a corner of the first intermediate panel diagonally across the first intermediate panel to the diagonally opposed corner. In other envisaged embodiments the weakened arrangement may comprise an at least substantially centrally located aperture and optionally four (or fewer or more) fold lines extending away from the aperture to each corner of the intermediate panel. The aperture may be circular in shape, diamond in shape, triangular in shape, quadrilateral in shape, pentagonal in shape, hexagonal in shape as examples.

It is also envisaged that the deformation of one or more of the intermediate panels of the handle structure may be uniform along the length of the handle structure or may vary along the length of the handle structure. The deformation may cause outward bowing or bulging of some or all of one or more of the intermediate panels further below the strap section. Alternatively or additionally, the deformation may cause inward bowing or bulging of some or all of one or more of the intermediate panels toward the strap section. Optionally, such distortion may set-up a more rigid three-dimensional handle structure having non-uniform or irregular cross-sectional shapes. In yet further envisaged embodiments, the deformation or distortion of one or more of the intermediate panels may be uniformly distributed along the length of the handle structure such that the handle structure does have a uniform cross-sectional shape along its length.

In other envisaged embodiments, the weakened arrangement (fold line 170*a*) between the first and second intermediate panels 168*a*, 168*b* may not be fully co-extensive with the first and second intermediate panels 168*a*, 168*b*. As such, the first and second intermediate panels 168*a*, 168*b* may in other embodiments be considered as a single "first intermediate panel" that is interrupted by a weakened arrangement, which weakened arrangement may comprise a linear fold or crease line 170*a*.

It is envisaged that in other embodiments, the strap carrying handle may be formed from one or more plies of material. Furthermore, it is envisaged that a cover top panel may be disposed on top of or beneath any panel comprising a strap section and therefore reference to inner and outer top panel should not be construed as limiting those panels to being the innermost or outermost panels.

It will be recognised that as used herein, directional references such as "top", "bottom", "front", "back", "end", "side", "inner", "outer", "upper" and "lower" do not limit the respective panels to such orientation, but merely serve to distinguish these panels from one another.

Whereas the handle strap has been defined in terms of cut edges, in other envisaged embodiments, these cut edges may comprise connecting nick portions so that the inner and outer top panels are integral panels with the straps which may be beneficial during automated processing and will give the appearance of a new and untampered package to the end consumer.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A carton comprising a strap handle, a top wall and end walls, the strap handle comprising a strap section that is formed at least partially in the top wall, the strap section being deployable above the top wall and being attached to each end thereof to the carton, the strap handle further comprising a grip structure affixed to an underside of the strap section, the grip structure comprising a series of foldably interconnected panels interconnected such that the interconnected panels are foldable into a substantially tubular 3-dimensional structure having three or more sides disposed at least partially beneath the strap section, the tubular 3-dimensional structure including at least one of the interconnected panels spaced at least in part below the underside of the strap section.

2. A carton according to claim 1 wherein, the strap section comprises two plies of material affixed together in face contacting relationship and wherein the grip structure is affixed to the lowermost of the two plies.

3. A carton according to claim 1 wherein the foldably interconnected panels comprise: a hinge panel that is hinged to an edge of the strap section; a fixing panel that is affixed to the underside of the strap section; and one or more intermediate panels connecting between the hinge panel and the fixing panel.

4. A carton according to claim 3 wherein the hinge panel is foldably connected to the strap section by a connection selected from the group consisting of: a linear weakened line, an arcuate weakened line, a linear fold line, an arcuate fold line, a linear series of full or half-depth cuts interrupted by crease lines and an arcuate series of full or half-depth cuts interrupted by crease lines.

5. A carton according to claim 3 wherein the one or more intermediate panels comprise a first intermediate panel and a weakened arrangement that facilitates the deformation of the first intermediate panel.

6. A carton according to claim 5 wherein the first intermediate panel is substantially rectangular and the weakened arrangement comprises any one or more or a combination of:

(i) an at least substantially centrally located aperture and four fold lines extending away from the aperture to each corner of the intermediate panel;

(ii) two intersecting fold lines that each extend from a corner of the first intermediate panel diagonally across the first intermediate panel to the diagonally opposed corner;

(iii) a fold line extending longitudinally down the centre of the first intermediate panel.

7. A carton according to claim 5 wherein the first intermediate panel is at least partially deformed by being bowed outwardly, further below the strap section of the strap handle.

8. A carton according to claim 3 wherein the hinge panel is hinged to the strap section by means of an arcuate fold line bowing in a first direction and wherein the one or more intermediate panels are hinged to the fixing panel by means of another arcuate fold line bowing in a second direction that is opposite to and a mirror image of the arcuate fold line bowing in the first direction.

9. A carton according to claim 8 wherein the hinge panel is substantially segment-shaped; the second intermediate panel is hinged to the fixing panel and is substantially segment shaped; and the first intermediate panel is disposed between and interconnected to each of the hinge panel and the second intermediate panel.

10. A carton according to claim 9 wherein the grip structure has a non-uniform cross-section that is substantially a triangular shape or a three-sided shape at each end of the grip structure and that is a five sided shape in a medial section of the grip structure.

11. A carton according to claims 10, wherein the strap section comprises two plies of material affixed together in face contacting relationship, and wherein each ply of the strap section is at least in part defined by an arcuate hinge edge, wherein a cushioning flap is hinged to each arcuate hinge edge and wherein the arcuate hinge edges of the strap section are similarly shaped to the hinging edges of the segment shaped second intermediate panel and hinge panel.

12. A carton according to claim 11 wherein folding of the two cushioning flaps out of the plane of the strap section pushes against the hinge panel and the second intermediate panel of the grip structure and thereby automatically causes the grip structure to be set-up into a 3-dimensional structure.

13. A carton according to claim 8 wherein the first intermediate panel is at least partially deformable about a longitudinal substantially centrally located fold line.

14. A carton according to claim 1 wherein the tubular 3-dimensional structure has four or more sides disposed at least partially beneath the strap section.

15. A carton according to claim 14 wherein the tubular 3-dimensional structure has a four-sided substantially rectangular cross-sectional shape.

16. A strap handle comprising a strap section formed from two-plies of material affixed together and having a grip structure affixed to an underside of the strap section, the grip structure comprising a series of foldably interconnected panels including a fixing panel, a hinge panel and one or more intermediate panels, the interconnected panels are foldable into a substantially tubular 3-dimensional structure having three or more sides disposed at least partially beneath the strap section, wherein each ply of the strap section is at least in pa r t defined by a hinge edge and a cushioning flap is hinged to each hinge edge and wherein folding of the two cushioning flaps out of the plane of the strap section automatically causes the inter connected panels to be set-up into the 3-dimensional structure.

17. A blank for forming a carton having a strap handle comprising a grip structure, the grip structure having three or more sides disposed at least partially beneath the strap section of the strap handle and having a substantially tubular 3-dimensional structure, the blank comprising a top panel, end panels and the strap section at least partially formed within the top panel and attached to the end panels, the grip structure comprising: a hinge panel hinged to the strap section, one or more intermediate panels connected to the hinge panel and a fixing panel coupled to the one or more intermediate panels and affixable to an underside face of the strap section for forming the grip structure when the carton is formed.

18. A blank according to claim 17 wherein the hinge panel is foldably connected to the strap section by a connection selected from the group consisting of: a linear weakened line, an arcuate weakened line, a linear fold line, an arcuate fold line, a linear series of full or half-depth cuts interrupted by crease lines and an arcuate series of full or half-depth cuts interrupted by crease lines.

19. A blank according to claim 17 wherein the one or more intermediate panels comprise a first intermediate panel and a weakened arrangement that facilitates the deformation of the first intermediate panel.

20. A blank according to claim 19 wherein the first intermediate panel is substantially rectangular and the weakened arrangement comprises any one or more or a combination of:

(iv) an at least substantially centrally located aperture and four fold lines extending away from the aperture to each corner of the intermediate panel;

(v) two intersecting fold lines that each extend from a corner of the first intermediate panel diagonally across the first intermediate panel to the diagonally opposed corner;

a fold line extending longitudinally down the centre of the first intermediate panel.

* * * * *